US006458218B1

(12) United States Patent
Savich

(10) Patent No.: US 6,458,218 B1
(45) Date of Patent: Oct. 1, 2002

(54) DEPOSITION AND THERMAL DIFFUSION OF BORIDES AND CARBIDES OF REFRACTORY METALS

(75) Inventor: Walter Savich, Guelph (CA)

(73) Assignee: Linamar Corporation, Guelph (CA)

( * ) Notice: Subject to any disclaimer, the term of this patent is extended or adjusted under 35 U.S.C. 154(b) by 0 days.

(21) Appl. No.: 09/759,299

(22) Filed: Jan. 16, 2001

(51) Int. Cl.[7] ..... C23C 8/40; C23C 8/44; C23C 10/24

(52) U.S. Cl. ..... 148/237; 148/278; 148/279; 148/281; 148/518; 148/530; 427/419.7

(58) Field of Search ..... 148/220, 237, 148/278, 279, 281, 518, 530; 427/328, 419.7

(56) References Cited

U.S. PATENT DOCUMENTS

| | | | | |
|---|---|---|---|---|
| 2,893,115 A | | 7/1959 | McCawley | |
| 3,024,176 A | | 3/1962 | Cook | |
| 3,444,058 A | | 5/1969 | Mellors et al. | |
| 3,887,443 A | | 6/1975 | Komatsu et al. | |
| 4,250,208 A | * | 2/1981 | Arai | 148/278 |
| 4,430,170 A | | 2/1984 | Stern | |
| 4,857,116 A | * | 8/1989 | Allam et al. | 148/279 |
| 4,935,073 A | * | 6/1990 | Bartlett et al. | 148/278 |

OTHER PUBLICATIONS

Arvin —TD Process, Arvin TD Center, Introducing the TD Process, Thermal Diffusion for hardening steel by Surface Modification.

Samsonov and Epik, Chapters 1 and 2, "Coatings of High–Temperature Materials"(Plenum Press, New York: 1966) (Pertinent Pages: Ch 1, pp. 16–18, 22 and 31; Ch 2, pp. 35, 38 and 39).

* cited by examiner

*Primary Examiner*—George Wyszomierski

(57) ABSTRACT

A method is provided for depositing and thermally diffusing a boride or a carbide of a refractory metal on a substrate of a workpiece. A layer of the refractory metal is deposited on the substrate. At least one of the elements boron and carbon is deposited from a source other than the workpiece on the workpiece having the refractory metal layer. The workpiece is heated at a temperature and for a time period sufficient to diffuse at least a portion of the deposited refractory metal into the substrate and at least a portion of the deposited boron or carbon into the refractory metal layer and the substrate to form a substantially uniform and metallurgically bonded layer of the boride or carbide of the refractory metal on the substrate.

23 Claims, No Drawings

DEPOSITION AND THERMAL DIFFUSION OF BORIDES AND CARBIDES OF REFRACTORY METALS

FIELD OF THE INVENTION

This invention relates to deposition and thermal diffusion to form a boride or carbide of a refractory metal on a substrate.

BACKGROUND OF THE INVENTION

Wear of metal surfaces, for example, in many types of machinery, is a problem for which many solutions have been proposed. Wear n many modem machines is aggravated by their high operational temperatures and loads, at which simultaneous metal oxidation, fatigue, diffusion, abrasion, or adhesion can occur. Refractory metal borides and carbides have the necessary hardness and resistance to high temperatures to resist wear.

Methods of electrodepositing refractory metals are known. For instance, such methods are disclosed in U.S. Pat. No. 2,828,251 Sibert et al.) and U.S. Pat. No. 3,444,058 (Mellors et al.). Mellors et al. disclose a method of electrodepositing refractory metals from a solution of the refractory metal fluoride in a molten alkali-fluoride eutectic mixture onto a substrate. The electrodeposited refractory metals form coating which is essentially unalloyed with the substrate. The method disclosed, however, results only in a coating of the refractory metal, and not the refractory metal boride or carbide. Furthermore, the coating is not metallurgically bonded to the substrate and it is therefore relatively less resistant to wear.

Sibert et al. disclose using a solid metalliferous form of the refractory metal to be deposited as an anode. However, Sibert et al. also disclose that, when the electrodeposition is carried out under high temperature and certain other conditions, the refractory metal forms a firmly adherent layer joined to a base me al substrate by a metal-to-metal bond. The process disclosed in Sibert et al. refers to alloying of the refractory metal and the base metal substrate, but not to forming a protective layer of a refractory metal boride or carbide.

U.S. Pat. No. 2,950,233 (Steinberg et al.) discloses a method of, firstly, forming a "cladding" layer of certain transition metals on a base metal substrate containing an amount of a transition metal-hardening element, such as carbon, nitrogen, boron or silicon, either interstitially or in solid solution. The cladding layer could be formed in much the same manner as disclosed by Senderoff et al. or Sibert et al., as referred to above. Secondly, the method requires the base metal substrate to be heated sufficiently to effect thermal diffusion of the transition metal-hardening element from the base metal substrate to the cladding layer of the refractory metal. U.S. Pat. No. 3,887,443 (Komatsu et al.) discloses a similar approach, used, however, with only V, Nb, and Ta.

The approaches disclosed in the Steinberg et al. patent and the Komatsu et al. patent suffer from the disadvantages that to ford borides, carbides or suicides, the substrate material must contain boron, carbon, or silica. This means that this method is limited to use where the substrate includes alloys containing carbon, boron or silica as a component.

In addition to methods of electrodepositing refractory metals and the elements boron or carbon on a substrate, other methods of depositing refractory metals and such elements on a substrate are known.

Finally, various approaches have been taken to electrodeposit certain refractory metals and certain other elements simultaneously from a fused salt bath. Some of these approaches are described in U.S. Pat. No. 3,697,390 (McCauley et al.) (borides of Ti, Zr, and Hf), U.S. Pat. No. 3,713,993 (Mellors et al.) ($ZrB_2$), U.S. Pat. No. 3,827,954 (McCauley et al.) (borides of Ti, Zr, and Hf), U.S. Pat. No. 3,880,729 (Kellner) ($TiB_2$), and U.S. Pat. No. 4,430,170 (Stem) (refractory metal carbides). In general, these approaches have been found to suffer from the disadvantage that their practical applications were problematic, as they do not generally involve stable processes. These approaches are very sensitive to impurities, and to minor variations in temperature and in the composition of the salt bath. Furthermore, these approaches do not provide a coating which is metallurgically bonded to the substrate.

There is therefore a need for a reliable method of forming a relatively uniform and metallurgically bonded layer of a boride or a carbide of a refractory metal on a substrate.

SUMMARY OF THE INVENTION

In one of its aspects, the present invention provides a method of providing a boride or a carbide of a refractory metal on a substrate of a workpiece. Included are the steps of depositing a layer of a refractory metal on the substrate, depositing at least one of the elements boron and carbon from a source other than the workpiece on the workpiece having the refractory metal layer, and heating the workpiece at a temperature and for a time period sufficient to diffuse at least a portion of the deposited refractor, metal into the substrate and at least a portion of the deposited boron or carbon into the refractory metal layer and the substrate to form a substantially uniform and metallurgically bonded layer of the boride or the carbide of the refractory metal on the substrate. The refractory metal is selected from the group consisting of Ti, V, Cr, Zr, Nb, Mo, Hf, Ta, and W.

In another aspect of the present i invention, there is provided a method of providing a boride or a carbide of a refractory metal on a substrate of a workpiece. The method includes the steps of depositing a layer of a refractory metal on the substrate, heating the substrate at a first temperature and for a first time period sufficient to diffuse at least a portion of the refractory metal layer into the substrate, and depositing at least one of the elements boron and carbon from a source other than the workpiece on the refractory metal layer. The substrate is heated at a second temperature and for a second time period sufficient to diffuse at least a portion of the deposited boron or carbon into the refractory metal layer and the substrate to form a boride or carbide of the refractory metal and to provide a substantially uniform and metallurgically bonded layer of the boride or the carbide of the refractory metal on the substrate. It is preferred that the layer of the refractory metal is deposited by electrodeposition.

In accordance with another aspect of the present invention, there is provided a method of providing a boride or carbide of a refractory metal on a substrate of a workpiece. The method includes the steps of providing a first molten salt bath of an anhydrous fused salt electrolyte in an inert container, the molten salt bath comprising a substantially eutectic mixture of at least one halide from the group consisting of alkali metal halides and alkaline earth metal halides and a reducing agent for a refractory metal, immersing an anode comprising the refractory metal in the first molten salt bath, immersing a cathode comprising the workpiece in the first molten salt bath, the workpiece being electrically conductive, and electrodepositing a layer of the refractory metal on the workpiece.

The workpiece with the electrode posited refractory metal thereon is heated to a first temperature in a range of about 700° C. to about 900° C. for a first time period sufficient to diffuse at least a portion of the electrodeposited refractory metal into the substrate such that a refractory metal layer is metallurgically bonded to the substrate. Subsequently, a second molten salt bath is provided in an inert crucible, the second molten salt bath comprising an anhydrous fused salt electrolyte comprising at least one halide from the group consisting of alkali metal halides and alkaline earth metal halides and a compound containing at least one second element from the group consisting of B and C. The cathode comprising the workpiece having at least a portion of the electrodeposited refractory metal diffused therein is immersed in the second molten salt bath. A layer of the second element is then electrodeposited from the second molten salt bath on the workpiece having the refractory metal layer. The workpiece having the second element electrodeposited on the layer of the refractory metal is heated to a second temperature in the range of about 700° C. to about 900° C. for a second time period sufficient to diffuse at least a portion of the boron or carbon into the refractory metal layer and the substrate to form a boride or carbide of the refractory metal and to provide a substantially uniform and metallurgically bonded layer of the boride or carbide of the refractory metal on the substrate.

It is preferred that the inert container contains a protective atmosphere of argon, for preventing contaminants from entering the container.

It is also preferred that the reducing agent is selected from the group consisting of a fluoride of the refractory metal and a chloride of the refractory metal.

Preferably, electrodepositing of the refractory metal is effected by passing direct current at a current density in the range of between about 5 mA per square centimetre to about 100 mA per square centimetre through the first molten salt bath. Also, electrodepositing of the second element is effected by passing direct current at a current density in the range of between about 200 mA per square centimetre to about 300 mA per square centimetre through the second molten salt bath.

Where B is the second element, the second molten salt bath additionally comprises a second reducing agent.

In another alternative embodiment, there is provided a substantially uniform layer of a compound comprising a refractory metal and at least one of the elements B and C metallurgically bonded on an electrically conductive substrate formed by electrodepositing and thermally diffusing the refractory metal on the substrate to form a refractory metal layer, and electrodepositing from a source other than the workpiece and thermally diffusing at least one of the elements boron and carbon on the refractory metal layer and into the refractory metal layer and the substrate to form the compound.

In another aspect of the present invention, there is provided a method of providing a carbide of a refractory metal on a substrate, of a workpiece. Included are the steps of providing a first molten salt bath of an anhydrous fused salt electrolyte in an inert container, the molten salt bath comprising a substantially eutectic mixture of at least one halide from the group consisting of alkali metal halides and alkaline earth metal halides and a reducing agent for a refractory metal, immersing an anode comprising the refractory metal in the first molten salt bath, immersing a cathode comprising the workpiece in the first molten salt bath, the workpiece being electrically conductive, and electrodepositing a layer of the refractory metal on the workpiece. Also included are the steps of heating the workpiece with the electrodeposited refractory metal thereon to a first temperature in a range of about 700° C. to about 900° C. for a first time period sufficient to diffuse at least a portion of the deposited refractory metal into the substrate such that a refractory metal layer is metallurgic ally bonded to the substrate, and providing a second molten salt bath in an inert crucible, the second molten salt bath comprising a substantially eutectic mixture of at least one of the flu rides of Li, Na, or K, including about two percent to about ten percent by weight the reducing agent for the refractory metal and about two percent to about ten percent by weight crystalline powder graphite. The cathode comprising the workpiece having at least a portion of the electrodeposited refractory metal diffused therein is immersed in the second molten bath, after which a layer of carbon is electrodeposited from the second molten salt bath on the workpiece having the refractory metal layer. The workpiece having the carbon electrodeposited on the layer of the refractory metal is heated to a second temperature in the range of about 850° C. to 900° C. for a second time period sufficient to diffuse at least a portion of the carbon into the refractory metal layer and the substrate to form a carbide of the refractory metal and to provide a substantially uniform and metallurgically bonded layer of the carbide of the refractory metal on the substrate.

Preferably, the refractory metal is Ta, and the second molten salt bath comprises about five percent by weight potassium heptafluorotantalate and about five percent by weight crystalline powder graphite.

In accordance with another aspect of the present invention, there is provided a method of providing a carbide of a refractory metal on a substrate of a workpiece. The method comprises the steps of providing a first molten salt bath of an anhydrous fused salt electrolyte in an inert container, the molten salt bath comprising a substantially eutectic mixture of at least one halide from the group consisting of alkali metal halides and alkaline earth metal halides and a reducing agent for a refractory metal, immersing an anode comprising the refractory metal in the first molten salt bath, immersing a cathode comprising the workpiece in the first molten salt bath, the workpiece being electrically conductive, and electrodepositing a layer of the refractory metal on the workpiece. The method also comprises heating the workpiece with the electrodeposited refractory metal thereon to a first temperature in a range of about 700° C. to about 900° C. for a first time period sufficient to diffuse at least a portion of the electrodeposited refractory metal into the substrate such that a refractory metal layer is metallurgically bonded to the substrate, providing a crystalline graphite powder in a inert crucible, burying the workpiece having at least a portion of the electrodeposited refractory metal diffused therein in the crystalline graphite powder, and compressing the crystalline graphite powder with pressure in the range of up to about 5,000 grams per square centimetre. Air is evacuated from the inert crucible. A layer of carbon is deposited from the crystalline graphite powder on the workpiece having the refractory metal layer. The workpiece is heated to as second temperature in the range of 1,000° C. to 1,200° C. for a second time period sufficient to diffuse at least a portion of the carbon in the refractory metal layer and the substrate to form a carbide of the refractory metal and to provide a substantially uniform and metallurgically bonded layer of the carbide of the refractory metal on the substrate.

In another aspect of the present invention, there is provided a method of providing a carbide of a refractory metal on a substrate of a workpiece. The method includes the steps of providing a first molten salt bath of an anhydrous fused salt electrolyte in an inert container, the molten salt bath comprising a substantially eutectic mixture of at least one halide from the group consisting of alkali metal halides and alkaline earth metal halides and a reducing agent for a refractory metal, immersing an anode comprising the refractory metal in the first molten salt bath, immersing a cathode comprising the work piece in the first molten salt bath, the workpiece being electrically conductive, electrodepositing a layer of the refractory metal on the workpiece, and heating the workpiece with the electrodedposited refractory metal thereon to a first temperature in a range of about 700° C. to about 900° C. for a first time period sufficient to diffuse at least a portion of the electrodeposited refractory metal into the substrate such that a refractory metal layer is metallurgically bonded to the substrate. A layer of carbon is deposited on said workpiece having the refractory metal layer by gas carburizing. The workpiece is heated to a second temperature in the range of 1,000° C. to 1,400° C. for a second time period sufficient to diffuse at least a portion of the carbon in the refractory metal layer and the substrate to form a carbide of the refractory metal and to provide a substantially uniform and metallurgically bonded layer of the carbide of the refractory metal on the substrate.

BRIEF DESCRIPTION OF THE PREFERRED EMBODIMENT(S)

In a preferred embodiment of the method of the present invention, a layer of a refractory metal is deposited on a workpiece including a substrate. At least one of the elements boron and carbon is then deposited from a source other than the workpiece on the refractory metal layer. The workpiece is then heated at a temperature and for a time period sufficient to diffuse at least a portion of the deposited refractory metal and at least a portion of the boron or carbon into the refractory metal layer and the substrate to form a substantially uniform and metallurgically bonded layer of the boride or the carbide of the refractory metal on the substrate.

The refractory metal is selected from the group consisting of Ti, V, Cr, Zr, Nb, Mo, Hf, Ta, and W.

The refractory metal or the carbon and boron can be deposited by any suitable method, for example, electrodeposition, thermal spray methods such as by flame spray or by plasma spray, or vapour-based methods such as pack cementation or physical vapour deposition (PVD) including cathodic arc, sputtering or electron beam evaporation.

In another preferred embodiment of the invention, the workpiece having the refractory metal deposited thereon is heated at a first temperature and for a first time period sufficient to diffuse a least a portion of the refractory metal layer into the substrate. A second element, being at least one of the elements boron and carbon, is then deposited from a source other than the workpiece on the refractory metal layer. The workpiece is then heated at a second temperature and for a second time period sufficient to diffuse at least a portion of the deposited boron or carbon into the refractory metal layer and the substrate to form a substantially uniform and metallurgically bonded layer of the boride or the carbide of the refractory metal on the substrate. Preferably, the layer of refractory metal is deposited by electrodeposition.

In yet another embodiment of the present invention, a first molten salt bath of a first anhydrous fused salt electrolyte is provided in an inert container. The first molten salt bath comprises a substantially eutectic mixture of at least one halide from the group consisting of alkali metal halides and alkaline earth me al halides and a reducing agent for a refractory metal. An anode comprising the refractory metal (being one of Ti, V, Cr, Zr, Nb, Mo, Hf, Ta, and W) is immersed in the first molten salt bath. After a cathode comprising a workpiece which is electrically conductive has been immerse in the first molten salt bath, a layer of the refractory metal is electrodeposited on the workpiece. The workpiece is heated to a first temperature, in a range of about 700° C. to about 900° C., for a first time period sufficient to cause thermal diffusion of at least a portion of the electrodeposited refractory metal into the substrate. As a result of this thermal diffusion, a refractor) metal layer is metallurgically bonded to the substrate. A second molten salt bath is then provided in an inert container. The second molten salt bath comprises an anhydrous fused salt electrolyte comprising at least one halide from the group consisting of alkali metal halides and alkaline earth metal halides and a compound containing at least one second element selected from tie group consisting of boron and carbon. A cathode comprising the workpiece having at least a portion of the electrodeposited refractory metal diffused therein is immersed in the second molten salt bath. A layer of the second element is then electrodeposited from the second molten salt bath on the workpiece. The workpiece is heated to a second temperature, the second temperature being in the range of about 700° C. to about 900° C., for a second time period sufficient to diffuse at least a portion of the boron or carbon into the refractory metal layer and the substrate to form a boride or carbide of the refractory metal and to provide a substantially uniform and metallurgically bonded layer of the boride or the carbide of the refractory metal on the substrate.

It is preferred that the electrodeposition of the refractory metal layer is carried out in a protective atmosphere of argon, to prevent contaminants from entering the container. Preferably, the argon is maintained at a pressure slightly greater than atmospheric pressure.

The reducing agent is selected from the group consisting of a fluoride of the refractory metal and a chloride of the refractory metal.

Electrodepositing of the refractory metal is effected by passing direct current at a current density in the range of between about 5 mA per square centimetre to about 100 mA per square centimetre through the first molten salt bath between the anode and the cathode. For Nb, a suitable reducing agent is potassium heptafluoroniobate, and for Ta, a suitable reducing agent is potassium heptafluorotantalate. In this embodiment, the electrodepositing of the second element is effected by passing direct current at a current density in the range of between about 200 mA per square centimetre to about 300 mA per square centimetre through the second molten salt bath. For boron, potassium tetrafluoroborate is a suitable reducing agent.

In general, the thicker the refractory metal boride or carbide coating desired, the longer the time required during which boriding or carburizing is carried out.

In the formation of the refractory metal layer, dendrites may form. This appears to be the result of the growth of the layer exceeding coherent disposition. When dendrites start to form, reverse current is applied to dissolve the m. In the alternative, to discourage the formation of dendrites, a levelling compound can be added to the first molten salt bath. For example, as is known in the art, potassium heptafluorotantalate can be used as a levelling agent for Nb electrodeposition, and aluminum oxide can be used as a levelling agent for electrodeposition of Zr and Mo.

For the refractory metal Nb and the second element B, the first time period is between about five minutes and about three hours depending on the desired thickness of the refractory metal boride or carbide coating. Preferably, the second temperature is about 800° C., and the second time period is between about one hour and about nine hours. The thicker the coating desired, the longer the first and second time periods.

For the refractory metal Nb and the second element C, the electrodeposition of the carbon is effected by passing direct current through the second molten salt bath at a current density of about 100 mA per square centimetre. The second temperature is about 750° C. and the second time period is about four hours.

For the refractory metal Ta, and the second element B, the first time period is between about five minutes and about three hours. In this embodiment, the second temperature is about 900° C. and the second time period is about seven and one-half hours.

In another embodiment of the method of the present invention, a substantially uniform layer of a compound comprising a refractory metal of Ti, V, Cr, Zr, Nb, Mo, Hf, Ta or W and at least one of the elements boron and carbon is formed which is metallurgically bonded to an electrically conductive substrate of a workpiece. The layer of the compound is formed by electrodepositing and thermally diffusing the refractory metal on the substrate to form a refractory metal layer, and then electrode positing from a source other than the workpiece and thermally diffusing at least one of the elements boron and carbon on the refractory metal layer and into the refractory metal layer and the substrate.

In yet another preferred embodiment, the invention comprises another method of providing a carbide of a refractory metal on a substrate of a workpiece. In this preferred embodiment, a refractory metal layer is deposited on the substrate, for example, by electrodeposition in the manner described above. The second molten salt bath comprises a substantially eutectic mixture of at least one of the fluorides of Li, Na, or K, including about two percent to about ten percent by weight th reducing agent of the refractory metal and about two percent to about ten percent by weight crystalline powder graphite. As in other preferred embodiments described above, the cathode which is immersed in the second molten salt bath is the workpiece, which has at least a port on of the electrodeposited refractory metal diffused therein. A layer of carbon is then electrodeposited from the second molten salt bath on the refractory metal layer, and the workpiece is heated to a second temperature in the range of about 850° C. to about 900° C. for a second time period sufficient to diffuse at least a portion of the carbon into the refractory metal layer and the substrate to form a carbide of the refractory metal and to provide a substantially uniform d metallurgically bonded layer of the carbide of the refractory metal on the substrate.

The second molten salt bath includes about five percent by weight the reducing agent of the refractory metal and about five percent by weight crystalline graphite powder. Also, it is preferred that the refractory metal in this preferred embodiment is Ta. Where the refractory metal is Ta, the reducing agent is preferably potassium heptafluorotantalate.

Various methods of carburizing may be used for providing a carbide of a refractory metal on a substrate of a workpiece. The refractory metal is deposited on the substrate by electrodeposition in the manner described above. Instead of using a second molten salt bath for carburizing, however, pack carburizing is utilized. A crystalline graphite powder is provided in an inert crucible. The workpiece having at east a portion of the electrodeposited refractory metal deposited thereon is buried in the crystalline graphite powder. The crystalline graphite powder is then compressed by pressure of up to about 5,000 grams per square centimetre. Air is evacuated from the crucible. After a layer of carbon is deposited from the crystalline graphite powder on the workpiece, the workpiece is heated to a second temperature in the range of about 1,000° C. to about 1,200° C. for a second time period sufficient to diffuse at least a portion of the carbon in the refractory metal layer and the substrate to form a carbide of the refractory metal and to provide a substantially uniform and metallurgically bonded layer of the carbide of the refractory metal on the substrate.

In accordance with another embodiment, a workpiece having a refractory metal layer electrodeposited thereon and at least a potion of the electrodeposited refractory metal diffused therein is subjected to gas carburizing. The gas carburizing results in the deposition of a layer of carbon on the refractory metal layer. The workpiece is then heated to a second temperature in the range of about 1,000° C. to about 1,400° C. for a second time period sufficient to diffuse at least a portion of the carbon in the refractory metal layer and the substrate to form a carbide of the refractory metal and to provide a substantially uniform and metallurgically bonded layer of the carbide of the refractory metal on the substrate. Subsequent to gas carburizing, the substrate is heated at a temperature and for a time period sufficient to diffuse at least a portion of the refractory metal and the carbon into t he substrate to form a substantially uniform and metallurgically bonded layer of the carbide of the refractory metal on the substrate.

The second temperature could be higher than 1,400° C., where the melting point of the substrate is substantially higher than 1,400° C. In this embodiment, the second temperature range is up to about 1,400° C. because 1,400° C. is lower than the melting point of many commonly used substrates.

Gas carburizing is described, for example, in G. L. Zhunkovskii, "The Vacuum Carbidization of Transition Metals of Groups IV and V", at 107–115 in *Refractory Carbides* (1974), edited by Grigorii V. Samsonov, and in Tsutsumoto, "Improvement of Ta filament for diamond CVD", in *Thin Solid Films* 317 (1998) 371–375, each of which is incorporated herein by reference. In a preferred embodiment, a refractory metal layer is deposited on a substrate of a workpiece, and the step of carburizing the workpiece having the refractory metal layer is achieved by means of gas carburizing.

Having fully described the present invention, the following examples are provided to further illustrate the principles of the disclosed invention and are not intended to limit the scope of the invention in any manner.

EXAMPLE 1

A first molten salt bath was prepared and placed in a nickel container. Samples of M4 tool steel, five centimeters long and in cross-section one-half centimeter by one-half centimetre, were coated with Nb. Electron microscopy of the interface between the deposited layer of refractory metal and the substrate revealed mutual diffusion of both material of a substrate and Nb for about 1 to 3 microns, proving that the refractory metal coat was metallurgically bonded to the substrate. The coatings of Nb on the samples were approximately 20 to 80 microns thick.

The first molten salt bath consisted of eutectic, or close to eutectic mixtures of two or more chlorides of Li, Na, and K. Temperatures varied from 700° C. to 900° C. Current varied also from 5 to 100 mA per square centimeter. The time required depended on the required thickness of the deposited layer of refractory metal. To enhance reduction of the refractory metal ions in the first molten salt bath, reducing agents were added. For Nb, a suitable reducing agent is potassium heptafluoroniobate.

To suppress formation of dendrites, and in order to have a uniform continuous layer of refractory metal electrodeposited, step current was applied in such a way that the first step was used to deposit the refractory metal layer. When the growth of the refractory metal layer exceeded coherent depositions and dendrites started to form, reverse current was applied to dissolve the dendrites. Subsequently, the process began again, until the refractory metal layer had achieved the predetermined required thickness.

The refractory metal electrodeposition was carried out in the nickel container under the protective atmosphere of argon. The argon was at a pressure slightly above atmospheric pressure.

After the desired thickness was reached, the sample was cleaned in water and placed in the second molten salt bath for boriding.

Boriding of samples coated with Nb was carried out in the protective argon atmosphere in the second molten salt bath. The second molten salt bath contained sodium tetraborate as a main boron carrier with up to 20% by weight potassium tetrafluoroborate as a reducing agent. The current applied was 224 mA per square centimeter, and a temperature of 800° C. was maintained for 6.5 hours. A continuous layer of brownish-gray color formed on the surface was determined, by means of X-ray diffraction, to include approximately 80% niobium diboride, 15% niobium, and 5% unidentified amorphous substance.

EXAMPLE 2

The method as described in Example 1 was repeated, except that instead of chlorides, the eutectic mixture of two or more fluorides of Li, Na, or K were used in the first molten salt bath. The boriding process lasted for about 7.5 hours, at 900° C. Formed on the surface was a continuous layer of brownish-gray color which was found, by using X-ray diffraction, to include approximately 80% niobium diboride and 20% niobium.

EXAMPLE 3

The method as described in Example 1 was repeated, except that the boriding process lasted for about 8 hours and 20 minutes at 850° C. A continuous layer of brownish-gray color was formed on the surface. The brownish-gray layer was found, by using X-ray diffraction, to include approximately 80% niobium diboride and 20% niobium.

EXAMPLE 4

The method as described in Example 2 was repeated, except that the refractory metal was Ta and instead of potassium heptafluoroniobate, potassium heptafluorotantalate was used as a reducing agent. A continuous layer of brownish-gray color formed on the surface was determined, by means of X-ray diffraction to include approximately 90% tantalum diboride and 10% tantalum.

EXAMPLE 5

Workpiece samples of M4 tool steel were coated with Nb, as described in Example 1. The second molten salt bath consisted of an equimolar mixture of sodium tetraborate and sodium carbonate, with the addition of sodium fluoride and potassium fluoride, and was placed into a graphite crucible. The cathode was the workpiece covered with Nb, and the anode was an ultrapure graphite rod. Carburizing was performed in the crucible for 4 hours. The current density was 100 mA per square centimeter at a working temperature of 750° C. for four hours. Formed on the surface was a continuous layer of dark gray color which was found, by using X-ray diffraction, to include approximately 20% niobium carbide and 15% niobium, the balance comprising iron oxide, iron carbide, and an unidentified amorphous substance.

EXAMPLE 6

The method described in Example 4 was repeated on a solid carbide insert. A continuous layer of brownish-gray color was formed on the surface. By means of X-ray diffraction, the brownish-gray color was found to include approximately 95% tantalum diboride, and 5% unidentified amorphous substance.

EXAMPLE 7

The method of Ta deposition described in Example 4 was repeated on a solid carbide insert. The second molten salt bath consisted of an eutectic or close to eutectic mixture of two or more fluorides of Li, Na, or K with 5% by weight of potassium heptafluorotantalate and 5% by weight of crystalline powder graphite. The anode was a graphite electrode. The applied current was 254 mA per square centimeter for two hours at the temperature of 870° C. A continuous layer of yellowish color formed on the surface was determined, by X-ray diffraction, to include approximately 97% tantalum carbide and 3% unidentified amorphous substance.

EXAMPLE 8

The method of Ta deposition described in Example 4 repeated on a solid carbide insert. The solid carbide insert, coated with Ta as described, was then placed into crystalline graphite power in a container and compressed at a pressure of 160 grams per square centimeter. Air was evacuated from the container. The sample, along with the graphite pack, was heated to 1050° C. and maintained at that temperature for a proximately 2 hours. Formed on the surface was a continuous yellowish layer which was found, using X-ray diffraction, to include approximately 20% tantalum carbide, 75% tantalum, and the balance tantalum oxides and other oxides.

It will be evident to those skilled in the art that the invention can take many forms and that such forms are within the scope of the invention as claimed. For example, any other method of depositing a refractory metal layer on a substrate of a workpiece, and any method of carburizing or boriding the refractory metal layer in which the carbon or boron is from a source other than the workpiece, may be used with thermal diffusion of the refractory metal and the carbon or boron into the substrate.

I claim:

1. A method of providing a boride or carbide of a refractory metal on a substrate of a workpiece comprising the steps of:

(a) providing a first molten salt bath of an anhydrous fused salt electrolyte in an inert container, the molten salt lath comprising a substantially eutectic mixture of at least one halide from the group consisting of alkali metal halides and alkaline earth metal halides and a reducing agent for a refractory metal;

(b) immersing an anode comprising the refractory metal in the first molten salt bath;

(c) immersing a cathode comprising the workpiece in the first molten salt bath, the workpiece being electrically conductive;

(d) electrodepositing a layer of the refractory metal on the workpiece;

(e) heating the workpiece with the electrodeposited refractory metal thereon to a first temperature in a range of about 700° C. to about 900° C. for a first time period sufficient to diffuse at least a portion of the electrodeposited refractory metal into the substrate such that a refractory metal layer is metallurgically bonded to the substrate;

(f) providing a second molter salt bath in an inert crucible, the second molten salt bath comprising an anhydrous fused salt electrolyte comprising at least one halide from the group consisting of alkali metal halides and alkaline earth metal halides and a compound containing at least one second element from the group consisting of B and C;

(g) immersing the cathode comprising the workpiece having at least a portion of the electrodeposited refractory metal diffused therein in the second molten salt bath;

(h) electrodepositing a layer of the second element from the second molten bath on said workpiece having the refractory metal layer; and (i) heating the workpiece having the second element electrodeposited on the layer of the refractory metal to a second temperature in the range of about 700° C. to about 900° C. for a second time period sufficient to diffuse at least a portion of the boron or carbon into the refractory metal layer and the substrate to form a boride or carbide of the refractory metal and to provide a substantially uniform and metallurgically bonded layer of the boride or carbide of the refractory metal on the substrate.

2. A method as defined in claim 1 wherein the inert container contains a protective atmosphere of argon, for preventing contaminants from entering the container.

3. A method as defined in claim 2 wherein the reducing agent is selected from the group consisting of a fluoride of the refractory metal and a chloride of the refractory metal.

4. A method as defined in claim 3 wherein electrodepositing of the refractory metal is effected by passing direct current at a current density in the range of between about 5 mA per square centimeter to about 100 mA per square centimeter through the first molten salt bath between the anode and the cathode.

5. A method as defined in claim 4 wherein electrodepositing of the second element is effected by passing direct current at a current density in the range of between about 200 mA per square centimeter to about 300 mA per square centimeter through the second molten salt bath.

6. A method as defined in claim 5 wherein the refractory metal is selected from the group consisting of Ti, V, Cr, Zr, Nb, Mo, Hf, Ta, and W.

7. A method as defined in claim 5 wherein the refractory metal is Nb.

8. A method as defined in claim 7 wherein the second element is B and the second molten salt bath additionally comprises a second reducing agent for B.

9. A method as defined in claim 8 wherein the first time period is between about five minutes and about three hours.

10. A method as defined in claim 9 wherein the second temperature is about 800° C. and the second time period is between about one hour and about nine hours.

11. A method as defined in claim 7 wherein the second element is C.

12. A method as defined in claim 11 wherein the first time period is between about five minutes and about three hours.

13. A method as defined in claim 12 wherein the electrodepositing of the C is effected by passing direct current through the second molten salt bath between the anode and the cathode at a current density of about 100 mA per square centimeter.

14. A method as defined in claim 13 wherein the second temperature is about 750° C. and the second time period is about four hours.

15. A. A method as defined in claim 5 wherein the refractory metal is Ta.

16. A method as defined in claim 15 wherein the second element is B and the second molten salt bath additionally comprises potassium tetrafluoroborate.

17. A method as defined in claim 16 wherein the first time period is between about five minutes and about three hours.

18. A method as defined in claim 17 wherein the second temperature is about 900° C. and the second time period is about seven and one-half hours.

19. A method of providing a carbide of a refractory metal on a substrate of a workpiece comprising the steps of:

(a) providing a first molten salt bath of an anhydrous fused salt electrolyte in an inert container, the molten salt lath comprising a substantially eutectic mixture of at least one halide from the group consisting of alkali metal halides and alkaline earth metal halides and a reducing agent for a refractory metal;

(b) immersing an anode comprising the refractory metal in the first molten salt bath;

(c) immersing a cathode comprising the workpiece in the first molten salt bath, the workpiece being electrically conductive;

(d) electrodepositing a layer of the refractory metal on the workpiece;

(e) heating the workpiece with the electrodeposited refractory metal thereon to a first temperature in a range of about 700° C. to about 900° C. for a first time period sufficient to diffuse at least a portion of the deposited refractory metal into the substrate such that a refractory metal layer is metallurgically bonded to the substrate;

(f) providing a second molten salt bath in an inert crucible, the second molten salt bath comprising a substantially eutectic mixture of at least one of the fluorides of Li, Na, or K, including a out two percent to about ten percent by weight the reducing agent of the refractory metal and about two percent to about ten percent by weight crystalline powder graphite;

(g) immersing the cathode comprising the workpiece having at least a portion of the electrodeposited refractory metal diffused therein in the second molten bath;

(h) electrodepositing a layer of carbon from the second molten salt bath on said workpiece having the refractory metal layer;

(i) heating the workpiece having the carbon electrodeposited on the layer of the refractory metal to a second temperature in the range of about 850° C. to about 900° C. for a second time period sufficient to diffuse at least a portion of the carbon into the refractory metal layer and the substrate to form a carbide of the refractory metal and to provide a substantially uniform and metallurgically bonded layer of the carbide of the refractory metal on the substrate.

20. A method as defined in claim 19 wherein the refractory metal is Ta.

21. A method as defined in claim 20 wherein the second molten salt bath comprises about five percent by weight potassium heptafluorotantalate and about five percent by weight crystalline powder graphite.

22. A method of providing a carbide of a refractory metal on a substrate of a workpiece comprising the steps of:

(a) providing a first molten salt bath of an anhydrous fused salt electrolyte in an inert container, the molten salt bath comprising a substantially eutectic mixture of at least one halide from the group consisting of alkali metal halides and alkaline earth metal halides and a reducing agent for a refractory metal;

(b) immersing an anode comprising the refractory metal in the first molten salt bath;

(c) immersing a cathode comprising the workpiece in the first molten salt bath, the workpiece being electricaly conductive;

(d) electrodepositing a layer of the refractory metal on the workpiece;

(e) heating the workpiece with the electrodeposited refractory metal thereon to a first temperature in a range of about 700° C. to about 900° C. for a first time period sufficient to diffuse at least a portion of the electrodeposited refractory metal into the substrate such that a refractory metal layer is metallurgically bonded to the substrate;

(f) providing a crystalline graphite powder in an inert crucible;

(g) burying the workpiece having at least a portion of the electrodeposited refractory metal diffused therein in the crystalline graphite powder;

(h) compressing the crystalline graphite powder with pressure in the range of up to about 5,000 grams per square centimeter;

(i) evacuating air from the inert crucible;

(j) depositing a layer of car bon from the crystalline graphite powder on said workpiece having the refractory metal layer; and (k) heating the workpiece to a second temperature in the range of about 1,000° C. to about 1,200° C. for a second time period sufficient to diffuse at least a portion of the carbon in the refractory metal layer and the substrate to form a carbide of the refractory metal and to provide a substantially uniform and metallurgically bonded layer of the carbide of the refractory metal on the substrate.

23. A method of providing a carbide of a refractory metal on a substrate of a workpiece comprising the steps of:

(a) providing a first molten salt bath of an anhydrous fused salt electrolyte in an inert container, the molten salt bath comprising a substantially eutectic mixture of at least one halide from the group consisting of alkali metal halides and alkaline earth metal halides and a reducing agent for a refractory metal;

(b) immersing an anode comprising the refractory metal in the first molten salt bath;

(c) immersing a cathode comprising the workpiece in the first molten salt bath, the workpiece being electrically conductive;

(d) electrodepositing a layer of the refractory metal on the workpiece;

(e) heating the workpiece with the electrodeposited refractory metal thereon to a first temperature in a range of about 700° C. to about 900° C. for a first time period sufficient to diffuse at least a portion of the electro deposited refractory metal into the substrate such that a refractory metal layer is metallurgically bonded to the substrate;

(f) depositing a layer of carbon said workpiece having the refractory metal layer by gas carburizing; and (g) heating the workpiece to a second temperature in the range of about 1,000° C. to about 1,400° C. for a second time period sufficient to diffuse at least a portion of the carbon in the refractory metal layer and the substrate to form a carbide of the refractory metal and to provide a substantially uniform and metallurgically bonded layer of the carbide of the refractory metal on the substrate.

* * * * *